US006227756B1

(12) United States Patent
Dubé et al.

(10) Patent No.: US 6,227,756 B1
(45) Date of Patent: May 8, 2001

(54) ASSEMBLY FOR ADJUSTABLY MOUNTING AN ACCESSORY ON A RAIL

(75) Inventors: Gilles Dubé; Serge Bisson; Michel Lacombe, all of Saint-Jean-Port-Joli (CA)

(73) Assignee: Rousseau Metal Inc., Quebec (CA)

( * ) Notice: Subject to any disclaimer, the term of this patent is extended or adjusted under 35 U.S.C. 154(b) by 0 days.

(21) Appl. No.: 09/248,298

(22) Filed: Feb. 11, 1999

(51) Int. Cl.[7] ..... F16B 12/30

(52) U.S. Cl. ..... 403/353; 248/235; 211/90.02; 211/187; 211/175; 403/3; 403/4

(58) Field of Search ..... 403/321, 353, 403/230, 3, 4; 248/235, 239, 250; 211/90.02, 187, 190, 175, 207

(56) References Cited

U.S. PATENT DOCUMENTS

| | | | | |
|---|---|---|---|---|
| 619,416 | * | 2/1899 | Hunter . | |
| 2,788,902 | * | 4/1957 | Nowicki . | |
| 2,902,166 | | 9/1959 | Bahr | 211/11 |
| 2,928,512 | * | 3/1960 | Slater et al. . | |
| 3,127,146 | * | 3/1964 | Fisher . | |
| 3,143,981 | * | 8/1964 | Tassell . | |
| 3,186,668 | | 6/1965 | Story | 248/158 |
| 3,248,079 | | 4/1966 | Kennedy | 248/242 |
| 3,269,558 | | 8/1966 | Hess | 211/184 |
| 3,574,378 | * | 4/1971 | Heywood | 403/230 |
| 3,786,933 | | 1/1974 | Vianzon | 211/90 |
| 3,872,802 | | 3/1975 | Scheerhorn et al. | 108/61 |
| 4,035,097 | * | 7/1977 | Bachand . | |
| 4,120,250 | | 10/1978 | Viessmann | 108/144 |
| 4,135,837 | * | 1/1979 | Suttles . | |
| 4,158,998 | * | 6/1979 | Clement . | |
| 4,228,906 | | 10/1980 | Jones | 211/126 |
| 4,349,113 | | 9/1982 | Schreiner | 211/103 |
| 4,349,171 | * | 9/1982 | Baldwin | 248/243 |
| 4,378,925 | | 4/1983 | Griffin | 248/242 |
| 4,405,052 | | 9/1983 | Spiros | 211/49 |
| 4,560,073 | | 12/1985 | King | 211/184 |
| 4,684,094 | | 8/1987 | Everett | 248/245 |
| 4,697,712 | * | 10/1987 | Valiulis | 211/187 |
| 4,712,286 | | 12/1987 | Wolf | 29/463 |
| 4,733,841 | | 3/1988 | Wilson | 248/222.1 |
| 4,753,354 | * | 6/1988 | Patterson | 211/26 |
| 4,852,839 | * | 8/1989 | Winter et al. | 248/225.1 |
| 4,858,774 | | 8/1989 | Winter et al. | 211/184 |
| 4,904,110 | * | 2/1990 | Klein | 403/379 |
| 4,971,281 | | 11/1990 | Steinbeck | 248/225.2 |
| 5,038,539 | | 8/1991 | Kelley et al. | 52/239 |
| 5,154,299 | | 10/1992 | Hwang | 211/11 |
| 5,167,391 | | 12/1992 | Simpson | 248/220.2 |
| 5,230,492 | | 7/1993 | Zwart et al. | 248/222.1 |
| 5,265,740 | | 11/1993 | Hodsden et al. | 211/187 |
| 5,287,974 | | 2/1994 | Buday | 211/184 |
| 5,392,902 | | 2/1995 | Vlastakis | 206/45 |
| 5,433,327 | | 7/1995 | Benvenuti et al. | 211/193 |
| 5,472,103 | | 12/1995 | Merl | 211/187 |
| 5,484,068 | | 1/1996 | Huang | 211/193 |
| 5,695,078 | | 12/1997 | Otema | 211/103 |
| 5,732,832 | | 3/1998 | Kordowski | 211/43 |

* cited by examiner

*Primary Examiner*—Lynne H. Browne
*Assistant Examiner*—Tomlyne A Malcolm
(74) *Attorney, Agent, or Firm*—McDermott, Will & Emery

(57) ABSTRACT

The mounting assembly is for adjustably mounting an accessory having a substantially planar portion onto a rail member having a longitudinal side channel with opposite longitudinal folds. The mounting assembly has an elongated latch member shaped for passage between the folds when the latch member is oriented substantially parallel to the channel, and for abutment against the folds when the latch member is turned at least partially transversely inside the channel. The mounting assembly has a tightening device for tightening the accessory to the latch member. A locking device is operatively associated with the planar portion of the accessory and the latch member to prevent relative rotation and translation thereof when the accessory is tighten to the latch member.

18 Claims, 2 Drawing Sheets

ASSEMBLY FOR ADJUSTABLY MOUNTING AN ACCESSORY ON A RAIL

FIELD OF THE INVENTION

The present invention relates to an assembly for mounting an accessory onto a rail member, and more particularly to a mounting assembly for adjustably mounting an accessory having a substantially planar portion onto a rail member having a longitudinal side channel with opposite longitudinal folds.

BACKGROUND

Shelving systems are used for many purposes and in various environments, at home or at work, in store rooms, in workshops, etc. In the industry sector, work stations are often provided with shelving systems combined with workbenches to support tools, accessories and hardware articles.

An important aspect of shelving systems looked for by the operators resides in its ability to be adapted and adjusted to suit various needs. Versatility, modularity, ease of use, robustness and life span of the shelving parts are key points to success for a particular line of shelving systems.

One kind of shelving system, which is particularly adaptable, has a frame formed of aluminium extruded upright rails having a longitudinal side channel with opposite longitudinal folds. A same rail can be shared by two side-by-side shelves.

The operators often need to mount accessories, tools or the like onto the rails. Presently, they do that with anything on hand, which usually results in more or less adequate mountings that may be potentially dangerous.

Known in the art is U.S. Pat. No. 4,852,839 (Winter et al.), which shows a manner of mounting a display member onto a tubular post member. The display member is releasably coupled to the tubular post member by an attachment system having a clamp member insertable through a slotted opening in the post member, and a plate for exerting a pressure against the outer wall of the post member by the screwing action of a head member. The installation of the attachment system requires difficult manipulations in order to correctly place the clamp member inside the post member before screwing the head member. By its construction, the attachment system must be positioned at an end of the display member to be attached, and the screwing of the head member must be performed with the display member in the way. The height adjustment of the attachment system along the post member is limited to the locations of the slotted openings made therein.

Examples of other attachment systems are given in U.S. Pat. Nos. 4,753,354 (Patterson et al.); U.S. Pat. No. 4,904,110 (Klein); and U.S. Pat. No. 5,167,391 (Simpson).

SUMMARY

An object of the invention is to provide a mounting assembly for adjustably mounting an accessory onto a rail member having a longitudinal side channel with opposite longitudinal folds, which is easy to use, fast mounted, and installed without the assistance of tools.

A subsidiary object of the invention is to provide such a mounting assembly which is slidable in the side channel so that the accessory can be set in an infinite number of positions along the rail.

Another subsidiary object of the invention is to provide such a mounting assembly which is unobstructive with mounting areas in front and behind the rail member, so that accessories mounted with the mounting assembly do not hinder the installation of shelves and other components connected to the rail member.

According to the present invention, there is provided a mounting assembly for adjustably mounting an accessory having a substantially planar portion onto a rail member having a longitudinal side channel with opposite longitudinal folds, said mounting assembly comprising:

an elongated latch member shaped for passage between the folds when the latch member is oriented substantially parallel to the channel, and for abutment against the folds when the latch member is turned at least partially transversely inside the channel;

tightening means for tightening the accessory to the latch member; and locking means operatively associated with the planar portion of the accessory and the latch member to prevent relative rotation and translation thereof when the accessory is tighten to the latch member.

BRIEF DESCRIPTION OF THE DRAWINGS

A detailed description of preferred embodiments will be given herein below with reference to the following drawings, in which like numbers refer to like elements.

DETAILED DESCRIPTION OF THE PREFERRED EMBODIMENTS

Figure 1:
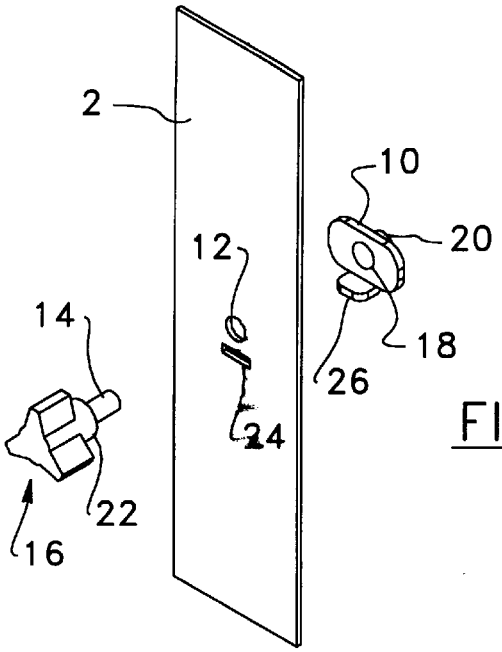
FIG. 1 is a perspective exploded view of the mounting assembly according to the invention.
Figure 2:
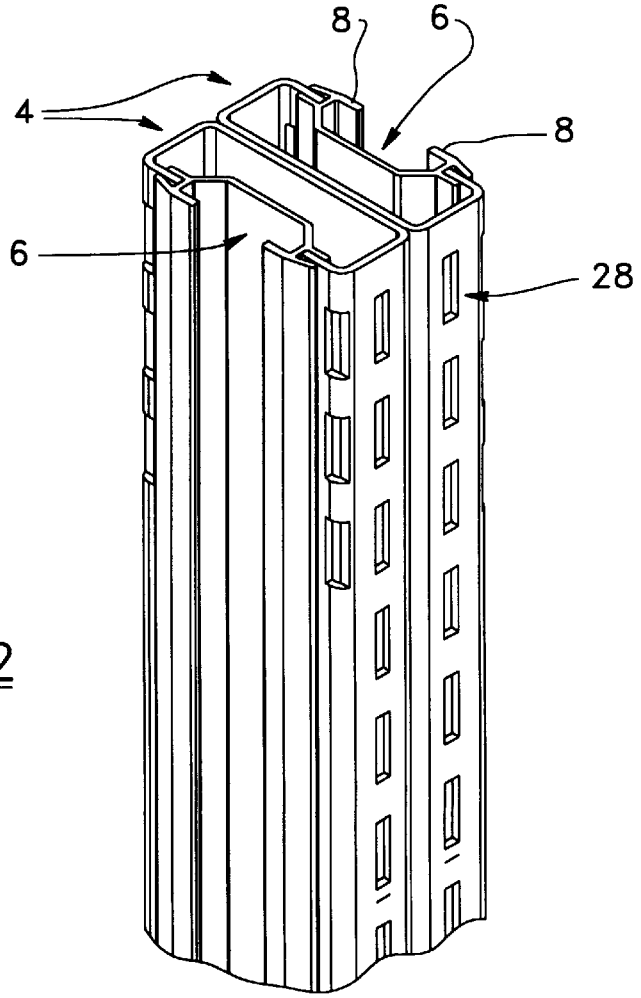
FIG. 2 is a perspective partial view of a rail member onto which an accessory can be mounted using the mounting assembly according to the invention.

Referring to FIGS. 1 and 2, there is shown a mounting assembly for adjustably mounting an accessory 2 having a substantially planar portion onto a rail member 4 having a longitudinal side channel 6 with opposite longitudinal folds 8. In FIG. 1, the accessory 2 is depicted as a simple plate. However, it will become apparent in view of the following description that the accessory can be formed of any other object or combination of objects provided that it has a planar portion that can be rotated adjacent to the channel 6. Thus, the accessory 2 can be, for example, a hook or a bracket for holding an article or a tool or any other implement on the side of the rail 4. In FIG. 2, there are shown two rails 4 in a side-by-side arrangement, with aluminium extrusions forming the channels 6.

Figure 3A:
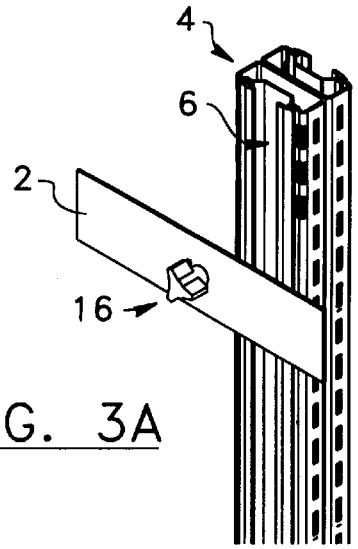
FIGS. 3A and 3B are perspective and top views showing a first installation step of the mounting assembly onto a rail member, according to the invention.
Figure 3B:
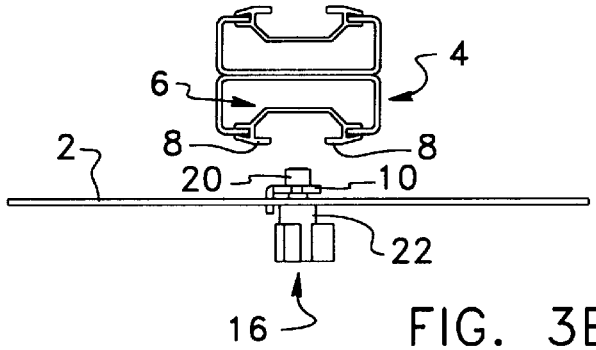
Figure 4A:
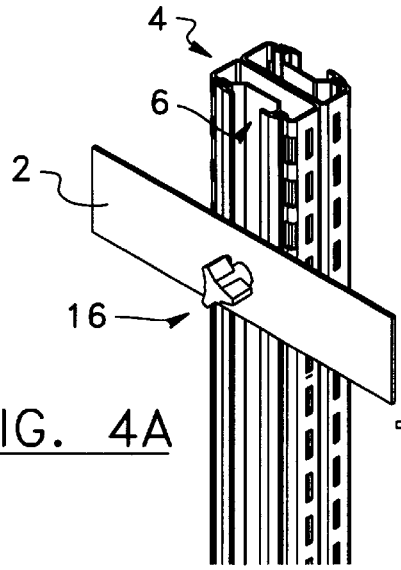
FIGS. 4A and 4B are perspective and top views showing a second installation step of the mounting assembly onto a rail member, according to the invention.
Figure 4B:
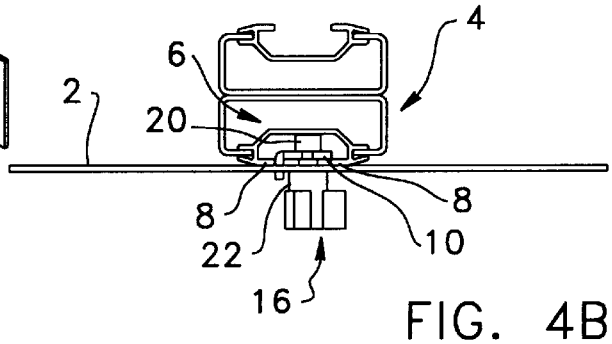
Figure 5A:
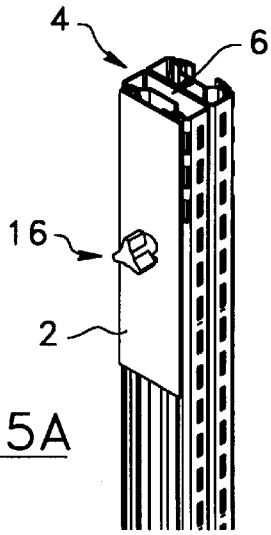
FIGS. 5A and 5B are perspective and top views showing a third installation step of the mounting assembly onto a rail member, according to the invention.
Figure 5B:
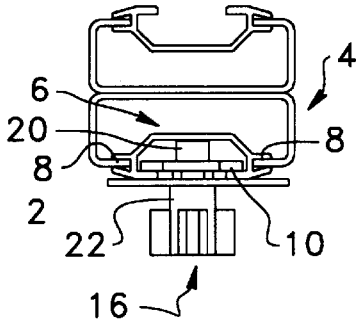

The mounting assembly has an elongated latch member 10 shaped for passage between the folds 8 when the latch member 10 is oriented substantially parallel to the channel 6 as shown in FIGS. 3–4A and 3–4B, and for abutment against the folds 8 when the latch member 10 is turned at least partially transversely inside the channel 6 as shown in FIGS. 5A and 5B.

The mounting assembly also has a tightening device for tightening the accessory 2 to the latch member 10. In the embodiment of the invention shown in the Figures, a hole 12 is made across the planar portion of the accessory 2. Of course, there is no need to make such a hole 12 if the accessory 2 is already provided with one. The tightening device is formed of a bolting arrangement having a threaded rod 14 insertable through the hole 12 made in the accessory 2 and boltingly assembling the accessory 2 with the latch member 10. The threaded rod 14 has an end provided with a head 16, and an opposite end screwable in a mated threaded hole 18 made in the latch member 10. The bolting of the accessory 2 to the latch member 10 can be achieved also with a nut securing a bolt rod projecting from the latch (not shown in the Figures).

The threaded hole 18 in the latch member 10 preferably extends through a collar portion 20 projecting on a side of the latch member 10 opposite to the accessory 2 when the latch member 10 and the accessory 2 are assembled together by the tightening device, as best shown in FIGS. 3–5B.

The head 16 preferably has a shoulder 22 facing the latch member 10 when the threaded rod 14 is screwed in the threaded hole 18 in the latch member 10, so that the shoulder 22 presses against the planar portion of the accessory 2 as the threaded rod 14 is screwed in the threaded hole 18 in the latch member 10.

The head 16 preferably has a handle shape to facilitate the bolting.

The latch member 10 preferably has a generally flat, oblong shape.

The mounting assembly has also a locking device operatively associated with the planar portion of the accessory 2 and the latch member 10 to prevent relative rotation and translation thereof when the accessory 2 is tighten to the latch member 10.

The locking device can be formed of a slot 24 made in one of the latch member 10 and the planar portion of the accessory 2, and a tab 26 projecting from the other one of the latch member 10 and the planar portion of the accessory 2. In the present embodiment of the invention, the slot 24 is made in the accessory 2, and the tab 26 projects substantially perpendicularly from the latch member 10 and is integral therewith. The tab 26 is insertable in the slot 24 so that the latch member 10 is movable closer to or away from the planar portion of the accessory 2 as the tightening device is operated. The slot 24 preferably extends tangentially with respect to the hole 12 in the accessory 2 at a predetermined distance from a center thereof, and the tab 26 projects from a side of the latch member 10 at a distance from a center of the threaded hole 18 in the latch member 10 that corresponds to the distance between the slot 24 and the hole 12 in the accessory 2.

The mounting assembly hereinabove described allows accessories to be quickly and easily installed onto the rail 4 without the assistance of any tool. Furthermore, its position is adjusted by sliding it up or down along the channel 6. Therefore, the accessory can take an infinite number of positions along the rail 4, thus is highly ergonomic. This is a particular feature of the mounting assembly because if an accessory requires two mounting assemblies, it will be possible to position the mounting assemblies no matter the length of the accessory.

Another particular feature of the mounting assembly according to the invention resides in that it remains unobstructive with the front and rear mounting areas 28 of the rail 4. The presence of accessories mounted with mounting assemblies according to the invention does not hinder the installation of shelves or other components on the rail 4.

Referring to FIGS. 3A and 3B, in order to mount the accessory 2 onto the rail 4, the mounting assembly, with the accessory 2, is first positioned in front of the channel 6 with the latch member 10 oriented parallel thereto.

Referring to FIGS. 4A and 4B, the mounting assembly is then positioned against the folds 8 with the latch member 10 inserted into the channel 6.

Referring to FIGS. 5A and 5B, the mounting assembly is then subjected to a 90° rotation, which causes the latch member 10 to become locked behind the folds 8 of the channel 6 since it is forced to follow the rotation of the accessory 2 due to the tab 26 and slot 24 arrangement. The accessory 2 is then tighten to the rail 4 by the bolting action of the handle shaped head 16 with respect to the latch member 10 locked in the channel 6.

To move the mounting assembly elsewhere along the rail 4 (for adjustment or for other purposes), the mounting assembly is loosen with the handle shaped head 16, slid to its next position along the channel 6, and fastened in place with the handle shaped head 16.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A mounting assembly for adjustably mounting an accessory having a substantially planar portion onto a rail member having a longitudinal side channel with opposite longitudinal folds, said mounting assembly comprising:

an elongated latch member adapted for passage between the folds when the latch member is oriented substantially parallel to the channel, and having a surface that is adapted to abut the folds when the latch member is turned at least partially transversely inside the channel;

tightening means adapted for tightening the accessory to the latch member; and locking means operatively associated with the planar portion of the accessory and the latch member and being adapted to prevent rotation and translation thereof when the accessory is tightened to the latch member.

2. The mounting assembly according to claim 1, wherein the tightening means comprises:

a bolting arrangement having a threaded rod adapted to be inserted through a hole made in the accessory to boltingly assemble the accessory with the latch member.

3. The mounting assembly according to claim 2, wherein the threaded rod has an end provided with a head, and an opposite end screwable in a mated threaded hole made in the latch member.

4. The mounting assembly according to claim 3, wherein the threaded hole in the latch member extends through a collar portion projecting on a side of the latch member opposite to the accessory when the latch member and the accessory are assembled together by the tightening means.

5. The mounting assembly according to claim 3, wherein the head has a shoulder facing the latch member when the threaded rod is screwed in the threaded hole in the latch member, so that the shoulder presses against the planar portion of the accessory as the threaded rod is screwed in the threaded hole in the latch member.

6. The mounting assembly according to claim 3, wherein the head has a handle shape.

7. The mounting assembly according to claim 1, wherein the latch member has a generally flat, oblong shape.

8. The mounting assembly according to claim 1, wherein the locking means comprise a slot made in one of the latch member and the planar portion of the accessory, and a tab projecting from the other one of the latch member and the planar portion of the accessory, the tab being insertable in the slot so that the latch member is movable closer to or away from the planar portion of the accessory as the tightening means is operated.

9. The mounting assembly according to claim 8, wherein the slot is made in the planar portion of the accessory, and the tab projects substantially perpendicularly from the latch member.

10. The mounting assembly according to claim 3, wherein the locking means comprise a slot made in the planar portion of the accessory, and a tab projecting substantially perpendicularly from the latch member, the tab being insertable in the slot so that the latch member is movable closer to or away from the planar portion of the accessory as the tightening means is operated.

11. The mounting assembly according to claim 10, wherein the slot extends tangentially with respect to the hole in the accessory at a predetermined distance from a center thereof, and the tab projects from a side of the latch member at a distance from a center of the threaded hole in the latch member that corresponds to the distance between the slot and the hole in the accessory.

12. The mounting assembly according to claim 1, wherein:

the tightening means comprise a hole across the planar portion of the accessory, and a bolting arrangement including a threaded rod insertable through the hole made in the accessory and boltingly assembling the accessory with the latch member, the threaded rod having an end provided with a head, and an opposite end screwable in a mated threaded hole across the latch member, the head having a handle shape; and the locking means comprise a slot made in the planar portion of the accessory, and a tab projecting substantially perpendicularly from the latch member on a side thereof that faces the accessory when the latch member and the accessory are assembled together by the tightening means, the tab being insertable in the slot so that the latch member is movable closer to or away from the planar portion of the accessory as the tightening means is operated.

13. The mounting assembly according to claim 12, wherein the threaded hole in the latch member extends through a collar portion projecting on a side of the latch member opposite to the accessory when the latch member and the accessory are assembled together by the tightening means.

14. The mounting assembly according to claim 13, wherein:

the head has a shoulder facing the latch member when the threaded rod is screwed in the threaded hole in the latch member, so that the shoulder presses against the planar portion of the accessory as the threaded rod is screwed in the threaded hole in the latch member;

the latch member has a generally flat, oblong shape; and the slot extends tangentially with respect to the hole in the accessory at a predetermined distance from a center thereof, and the tab projects from the side of the latch member at a distance from a center of the threaded hole in the latch member that corresponds to the distance between the slot and the hole in the accessory.

15. A mounting assembly for adjustably mounting an accessory having a substantially planar portion onto a rail member having a longitudinal side channel with opposite longitudinal folds, said mounting assembly comprising:

a latch member adapted to pass between the folds of the rail member when the latch member is oriented substantially parallel to the channel of the rail, and adapted to abut the folds when the latch member is turned at least partially transversely inside the channel;

a tightening element adapted to secure the accessory to the latch member, the tightening element including a bolting arrangement having a threaded rod adapted to be inserted through the accessory; and a tab extending from one of the latch member and the accessory adapted to engage a slot in the other of the latch member and the accessory to prevent the accessory from rotating with respect to the latch member.

16. A shelving system comprising:

an accessory having a substantially planar portion;

a rail member having a longitudinal side channel and opposite longitudinal folds;

a latch member adapted to pass between the folds of the rail member when the latch member is oriented substantially parallel to the channel, and adapted to abut the folds when the latch member is rotated transversely inside the channel of the rail member;

a bolting arrangement having a head and a threaded rod extending from the head that is insertable through the planar portion of the accessory to secure the accessory to the latch member, wherein the substantially planar portion of the accessory is drawn tightly against the rail members to secure the accessory; and a tab extending from one of the accessory and the latch member that engages the other of the accessory and the latch member to prevent the accessory from rotating with respect to the latch member.

17. A shelving system as claimed in claim 16, wherein the latch member has a threaded hole that receives the threaded rod.

18. A shelving system as claimed in claim 17, wherein the head has a shoulder extending toward the latch member that engages the planar portion of the accessory.

* * * * *